United States Patent [19]

Gibson

[11] 4,182,275

[45] Jan. 8, 1980

[54] BOILERS

[75] Inventor: Thomas Gibson, West Yorkshire, England

[73] Assignee: E. Green & Son Ltd., England

[21] Appl. No.: 870,425

[22] Filed: Jan. 18, 1978

[30] Foreign Application Priority Data

Jan. 21, 1977 [GB] United Kingdom ..... 2573/77

[51] Int. Cl.[2] ..... F22B 1/02; F22B 21/00

[52] U.S. Cl. ..... 122/7 R; 122/336

[58] Field of Search ..... 122/7 R, 7 B, 235 Z, 122/333, 336, 337

[56] References Cited

U.S. PATENT DOCUMENTS

| | | | |
|---|---|---|---|
| 372,360 | 11/1887 | Culver | 122/337 |
| 1,651,646 | 12/1927 | Trasenster | 122/333 |
| 1,839,125 | 12/1931 | Smith | 122/7 |
| 2,081,697 | 5/1937 | Falla | 122/7 |
| 2,620,780 | 12/1952 | Marquez, Jr. | 122/7 |
| 4,054,107 | 10/1977 | Horlitz, Jr. | 122/7 |

FOREIGN PATENT DOCUMENTS

| | | | |
|---|---|---|---|
| 383675 | 10/1923 | Fed. Rep. of Germany | 122/235 |
| 466698 | 6/1937 | United Kingdom | 122/235 |
| 471619 | 9/1937 | United Kingdom | 122/235 |

OTHER PUBLICATIONS

The Engineer, Feb. 8, 1979 "Design".

"Description of the Babcock & Wilcox Water-Tube Boiler", p. 44.

*Primary Examiner*—Kenneth W. Sprague

*Attorney, Agent, or Firm*—Allegretti, Newitt, Witcoff & McAndrews

[57] ABSTRACT

A boiler including a main bank of riser tubes and at least one downcomer tube which are connected by upper and lower headers of flat construction. The main bank of tubes being arranged within a housing the bank of riser tubes being adjacent a furnace combustion chamber.

4 Claims, 1 Drawing Figure

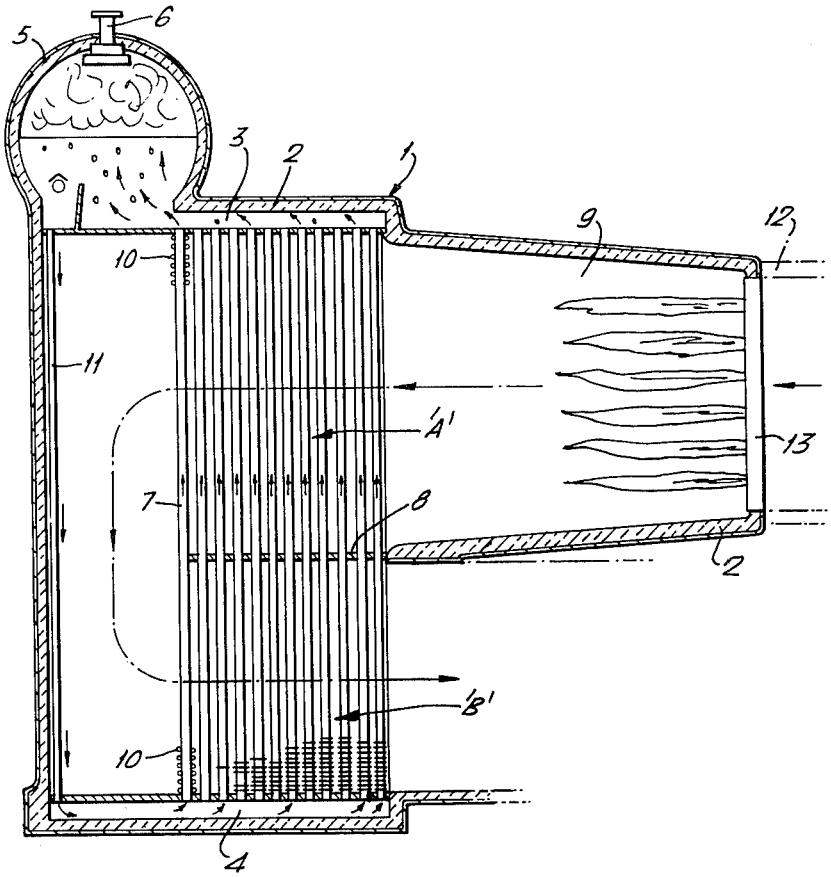
6
5
3
2
1
9
12
10
11
A'
13
7
8
2
B'
10
4

BOILERS

BACKGROUND OF THE INVENTION

This invention relates to boilers and more particularly to the main tube bank construction of such boilers.

An aim of the present invention is to provide a boiler which is of compact design, economic and adaptable.

SUMMARY OF THE INVENTION

According to the present invention there is provided a boiler comprising a housing, upper and lower headers within the housing, a bank of riser tubes and at least one downcomer tube connecting the upper and lower headers, the bank of riser tubes being located adjacent a furnace combustion chamber which is fed with heated gases, in which the headers are of flat construction.

Preferably, the upper header is made integral with a steam drum having a steam outlet.

Conveniently, the main bank of riser tubes incorporate a superheated section.

In a preferred construction the inlet to the combustion chamber for the heated gases is provided with supplementary or auxiliary gas burners to heat the waste gases.

Preferably, waste gases from the combustion chamber pass through a flow tube connected with a chimney for gaseous waste products.

DESCRIPTION OF THE FIGURE

The invention will now be described, by way of example only, with reference to the accompanying drawings which is a vertical cross-section through a boiler according to the invention.

DETAILED DESCRIPTION

Referring now to the drawing in detail the boiler comprises a housing 1 which has a layer of heat insulating material 2 and outer casings of aluminium sheet. Located within the housing is an upper header 3 and a lower header 4 of generally flat construction. The upper header 3 is formed integrally with a steam drum 5 having a steam outlet 6.

Arranged between the upper and lower headers are a main bank of riser tubes 7 the side walls of which are of membrane construction. These tubes 7 are fixed at right angles to the upper header 3 and the lower header 4 and have a baffle 8 located intermediate the ends thereof. The bank of tubes 7 are located adjacent a furnace combustion chamber 9 and the gases flow from the combustion chamber through the tube bank and via a gas outlet to a chimney (not shown) to remove the heated waste gases flowing in the boiler.

The main bank of tubes comprises a plain tube section "A" and an extended surface tube Section "B", divided by the baffle 8. The section "A" may optionally be joined to the section "B" by a superheater section 10.

The upper header 3 is also joined to the lower header 4 by a bank of downcomer tubes 11 which have a membrane wall construction.

The combustion chamber 9 has an inlet 12 for heated waste gases which pass through supplementary or auxiliary gas burners 13.

In operation waste gases which are partially heated are passed through the inlet to the furnace combustion chamber and are further heated by the supplementary or auxiliary gas burners. The heated gases pass through the main tube bank via the plain tube section "A" downwardly in the boiler housing and out of the boiler via the extended surface tube section "B" to a gas outlet and thence to a chimney (not shown).

Water flowing in the riser tubes is heated and passes to the upper header as a water and steam mixture and the steam is separated from the entrained water where it is removed via the steam outlet. The separated water, together with additional water, flows via the downcomer tubes to the lower header and the cycle is repeated. If required the superheater section is used whereby the steam separated from the heated water and steam mixture is passed through the superheater tubes which are heated by the flue gases to a sufficiently high temperature.

The improved boiler construction has a number of advantages:

(a) the simple flat construction of the headers require little or no tube bending within the main bank of riser tubes, with the consequent saving in manufacturing costs;

(b) all the tubes are fixed at right angles to their respective headers resulting in a more economical construction and efficient sealing;

(c) membrane tube wall construction for all outer casings which eliminates the usual sealing costs and its associated problems;

(d) unit, being natural circulation, will be almost wholly at saturation temperature eliminating any differential expansion problems;

(e) the boiler is ideally suited for supplementary and auxiliary gas firing (intertube boilers);

(f) the boiler is adaptable to conventional gas fired boiler application;

(g) the boiler can be shop assembled and tested for all but the larger units.

What is claimed is:

1. An improved boiler comprising, in combination:

(a) an enclosed housing defined by an upper wall, a lower wall and enclosing side walls;

(b) a combustion chamber positioned at the upper wall with a gas inlet in one side wall of the housing to the chamber;

(c) a gas outlet in one side wall adjacent the lower wall, said outlet separated from the combustion chamber by a baffle wall and positioned below the combustion chamber;

(d) an upper header at the upper wall having a generally rectangular, flat construction and generally extending across the top wall;

(e) a lower header at the lower wall having a generally rectangular, flat construction and extending across the bottom wall;

(f) a plurality of substantially straight riser tubes extending from the lower header to the upper header, said riser tubes positioned adjacent the inlet and combustion chamber at their upper end and adjacent the outlet at the lower end, said tubes providing means for heating fluid flowing upwardly in the tubes by natural convection and for heat exchange with the flowing gas inflow through the inlet chamber of the boiler and thence through the boiler and the outlet by natural convection;

(g) a plurality of downcomer tubes adjacent the side wall of the boiler opposite from the gas inlet chamber, said downcomer tubes connecting the upper header with the lower header and circulating fluid therebetween by natural convection; and (h) a steam drum attached to the upper header adjacent the intersection of the upper and sidewalls including a steam outlet for discharge of steam.

2. A boiler according to claim 1 wherein the tubes are fixed at right angles to their respective headers.

3. A boiler according to claim 1 further comprising supplementary gas burners, at said inlet to the combustion chamber to further heat the inlet gases.

4. A boiler according to claim 1 wherein the outer wall has a membrane wall construction to insulate the boiler.

* * * * *